US011066771B2

(12) United States Patent
Zarcone et al.

(10) Patent No.: US 11,066,771 B2
(45) Date of Patent: Jul. 20, 2021

(54) METHOD FOR OPERATING A WASHING MACHINE AND WASHING MACHINE

(71) Applicant: E.G.O. Elektro-Geraetebau GmbH, Oberderdingen (DE)

(72) Inventors: Carmelo Zarcone, Bretten (DE); Wolfgang Thimm, Karlsruhe (DE); Kay Schmidt, Oberderdingen (DE); Uwe Schaumann, Oberderdingen (DE); Michael Riffel, Oberderdingen (DE); Juergen Eiselt, Ilertissen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 16/648,746

(22) PCT Filed: Oct. 25, 2017

(86) PCT No.: PCT/EP2017/077357
§ 371 (c)(1),
(2) Date: Mar. 19, 2020

(87) PCT Pub. No.: WO2019/081013
PCT Pub. Date: May 2, 2019

(65) Prior Publication Data

US 2020/0270795 A1 Aug. 27, 2020

(51) Int. Cl.
*D06F 33/32* (2020.01)
*D06F 34/22* (2020.01)
(Continued)

(52) U.S. Cl.
CPC ..... *D06F 33/32* (2020.02); *D06F 34/22* (2020.02); *D06F 39/02* (2013.01); *D06F 39/083* (2013.01); *D06F 39/10* (2013.01); *D06F 2103/14* (2020.02)

(58) Field of Classification Search
CPC ..... D06F 39/10
See application file for complete search history.

(56) References Cited

U.S. PATENT DOCUMENTS

2012/0060300 A1 3/2012 Kim et al.

FOREIGN PATENT DOCUMENTS

| | | | |
|---|---|---|---|
| JP | 2012-065865 | A | 4/2012 |
| JP | 2014-147549 | A | 8/2014 |
| WO | WO-2013/068300 | A1 | 5/2013 |

OTHER PUBLICATIONS

Intenrational Searching Authority, International Search Report and Written Opinion for International Application No. PCT/EP2017/077357, dated Jun. 25, 2018, (11 pages), European Patent Office, Rijswijk, The Netherlands.

*Primary Examiner* — Spencer E Bell
(74) *Attorney, Agent, or Firm* — Alston & Bird LLP

(57) ABSTRACT

A washing machine has a drum, a sump underneath the drum, a water circulation including an extractible drawer for introducing detergent or additives, the water circulation being in fluid connection to detecting means for detecting microfibers or contamination in the water and a circulation pump and pipes for circulating water. A method for its operation comprises the steps of branching off an amount of water circulating in the circulation and transporting it to the detecting means for being analyzed and analyzing the water in the detecting means. Depending on the result of this analysis, a filtering process with filtering means for filtering out the microfibers from the water is activated. The microfibers that have been filtered out can be collected and then removed easily from the washing machine.

23 Claims, 4 Drawing Sheets

(51) Int. Cl.

| | |
|---|---|
| ***D06F 39/02*** | (2006.01) |
| ***D06F 39/08*** | (2006.01) |
| ***D06F 39/10*** | (2006.01) |
| ***D06F 103/14*** | (2020.01) |

METHOD FOR OPERATING A WASHING MACHINE AND WASHING MACHINE

CROSS REFERENCE TO RELATED APPLICATIONS

This application is a National Stage Application, filed under 35 U.S.C. 371, of International Application No. PCT/EP2017/077357, filed May 2, 2019; the contents of which are hereby incorporated by reference in its entirety.

BACKGROUND

Related Field

The invention is directed to a method for operating a washing machine and a corresponding washing machine itself.

It is known from the prior art, for example WO 2013/068300 A1, to provide at least one filtration device in a washing machine in potentially several locations. This serves for cleaning washing water or rinsing water in order to lower water consumption for ecological reasons.

BRIEF SUMMARY

It is an object of the invention to provide a method for operating a washing machine and a corresponding washing machine to overcome problems of the prior art, wherein preferably a better filtration is possible, especially of microfibers, and that in particular can be used without major inconvenience for a user.

This object is solved by a method with the features of claim 1 and a corresponding washing machine with the features of claim 22. Advantageous and preferred configurations of the invention are the subject of the further claims and are explained in more detail below. In this case, some of the features are described only for the method for operating a washing machine or only for the corresponding washing machine. However, regardless of this, they are intended to be able to apply by themselves for the method and for the washing machine independently of one another. The invention is also directed to a combined washing machine and dryer combined in one, which in the context of this invention is also regarded as a washing machine.

The wording of the claims is made to the content of the description by means of express reference.

In the method for operating a washing machine according to the invention, this washing machine has a drum for conducting a washing process therein and a sump located underneath the drum for collecting water exiting the drum. A water circulation includes a drawer or similar receptacle for introducing detergent or additives for the washing process that can be extracted and/or removed from the washing machine or be accessed in any way, for example be rotated for access. The water circulation is in fluid connection to detecting means for detecting microfibers or contamination in the water that are provided in the machine at a location that will be described in greater detail later on. A circulation pump is provided for circulating water in the circulation of the washing machine and pipes or hoses are provided for connecting the components described before. The washing machine may be a household appliance or a professional device in a deanery. It may also be a combined appliance as a machine to wash and to dry in the same drum, in particular directly consecutively.

The method itself comprises the steps of branching off an amount of water circulating in the circulation of the washing machine and bringing or transporting this branched-off water to the detecting means for being analyzed so that the water is analyzed in these detecting means. Microfibers or other contamination can be detected depending on what may specifically be searched for, which in the case of the invention are microfibers. Depending on the result of this analysis, if microfibers or other critical contamination has been detected, preferably with a percentage above a certain activation threshold, a filtering process is activated with filtering means provided in the washing machine for filtering out the microfibers and/or the contamination from the water that is exiting the drum via the water circulation or that shall be pumped out of the washing machine to a sewage line or the like of a house where the machine is installed.

In this way it is possible to identify microfibers in the water coming out of the drum in order to then activate or use filtering means to filter out these microfibers to avoid them getting into the sewage system and from there into the natural water circulation. The activation of the filtering means only in case when they are needed serves to facilitate a water circulation in cases where filtering is not necessary due to a lack of microfibers in the water. Also the filtering means are conserved for a longer lifetime. This again opens up the possibility to use the filtering means in a perfect state when filtering microfibers out of the water is necessary.

Preferably a differentiation is made between different types of fibers in a step before activating the filtering process. Such a step can help determine whether filtering is necessary at all. Cotton fibers and other organic fibers on the one hand need not be filtered because they are regarded as not critical or even dangerous. Synthetic fibers on the other hand should be filtered out according to the invention due to their dangerous impact on nature. If several kinds of fibers are present in the water, a filtering step will remove both from the water. This cannot be changed and will also not be a problem, only the amount of filtered matter will be higher.

Such a differentiation of fibers may preferably be made with sensors in the detecting means, in particular at least one sensor from a group of sensors such as optical sensors, opacimeter sensors, spectrometer sensors, preferably an IR spectrometer, sedimentation analysis sensors, tenside sensors or any combination of these. These sensors are partly rather sensitive or complicated with regard to their working environment.

The detecting means may have a detection chamber with a filter for filtering out particles from the water to be analyzed, which then may also be seen as a filter chamber. In addition or alternatively, they may have a sedimentation chamber for particles from the water to set down in for analysis of the resulting sediment. An analysis can be made in particular by density, color, form and/or size. This may advantageously depend on the best way to surely identify such microfibers from synthetic material from organic fibers being of no concern.

The sedimentation chamber can at first be cleaned by flushing with fresh water to remove dirt or particles potentially distorting the detecting means or a sensor thereof. A clean environment is a prerogative for an exact and reliable analysis. This step may also be used to calibrate the sensor with the fresh water. After cleaning the water to be analyzed can be filled into the sedimentation chamber.

A spectrometer sensor can be used to analyze the sediment in the detecting or sedimentation chamber after reduction or removal of the water from the sedimentation chamber. In the analysis to follow a spectrometer or a light beam of the spectrometer, respectively, is swept over the ground of the sedimentation chamber with the sediment thereupon. It is possible to use both methods, a spectrometry as well as an optical analysis. If microfibers are present in the sediment, possibly together with other fibers from the laundry, they can thus be detected, at least if they are present with a certain percentage or in a certain volume.

In another option, also fresh water may be analyzed by a sensor in the washing machine, preferably in the detecting means, to be able to determine, for example, any contamination in the fresh water or a degree of water hardness. A rinsing or cleaning of all the sensors with fresh water may also be used to calibrate these sensors for better accuracy.

A pre-filter can be arranged before the detecting means for filtering out larger particles, preferably with a size of more than 1 mm or more than 3 mm. Such particles can include anything that is usually washed out of clothes like small stones, fluff, coins or the like. The pre-filter may be cleaned by flushing with water pumped into the drum, wherein these larger particles filtered out may be flushed into the sewage. As a main purpose, the detecting means should be kept free of these particles. Also a pre-filter could be a single use device to be disposed of after use or if it is clogged.

The detecting means may have a control for performing the analysis, wherein the control may be connected to a database for supporting the detection process. This may advantageously be a database in a cloud connected to via internet. Data about various microfibers and their specifics may be provided with the option to include new microfibers that would otherwise need a new control.

The microfibers that need filtering are synthetic fibers, preferably from the group of Polyamide, Polyester, PVC or Acryl fibers. Various other microfibers may be included in the group of fibers that need to be filtered out and that need an activation of the filtering, respectively.

The size of the microfibers to be filtered out may be with a length starting from 1 μm and up to 2 mm or only 1 mm. Larger microfibers are regarded as less critical due to less environmental impact, so the need to also filter out these is lessened.

A filtering process for the filtering means to filter out microfibers from the water is preferably activated at least twice or for two periods during a complete washing cycle. So one activation period may be during a rinsing step of the washing cycle which is for removing detergent from the laundry. Another activation period may be during a spinning step for dehydrating the laundry after the rinsing step. In these two steps larger amounts of water can be loaded with microfibers from the laundry, and also due to the mechanical treatment of the laundry by intense moving and spinning more microfibers may be produced or washed out of the laundry.

In a preferred embodiment, only a fraction of the water circulating in the water circulation may be branched off and introduced into or transported to the detecting means for analysis. This is mainly with the aim to allow for a rather exact analysis with sufficient time. Preferably 0.1% up to 10% of the volume of circulating water may be branched off, rather less than more. Experience has shown that if microfibers are present in the water coming from the laundry, their distribution is quickly rather even so that only a small amount of water need to be analyzed. It may also be preferably provided that only once or twice an analysis is made during one washing cycle, more preferably one up to five minutes after the start of the washing cycle. This should be made before any of this water is let out of the machine into the sewage line due to the potential risk of microfibers being present in this water.

A filtering process can be activated by introducing the filtering means into to the circulation or to a water outlet from the circulation and out of the washing machine to a sewage line or by connecting the filtering means to the circulation or to the water outlet. This allows for the filtering means to be present and in use when needed on the one hand, and to be out of the way if they are not needed.

Preferably, the detecting means may be located in a region of the washing machine with less than average vibration to avoid vibration of the detecting means as much as possible. This allows for a better and more precise analysis with the detecting means. The detecting means may be located in an upper region in a housing of the washing machine. This may in particular be in an extractible and/or removable drawer for better accessibility and the option to exchange the detecting means or to repair them if needed. Such an extractible and/or removable drawer may be the one used in most washing machines for introducing detergents and additives for the washing process, so this can be provided with a multi-function for easier and deeper integration.

A branch duct may be provided that leads from the circulation to a before-described extractible and/or removable drawer in which the detecting means can preferably be located. This can be used to bring the water to be analyzed to the detecting means. The branch duct may end above this drawer such that water being branched off of the circulation can be dropping into the drawer or can flow from above into the drawer. Pumps or the like are not necessarily needed above the drawer to keep the construction simple and robust. A valve or a divider may be provided to be able to bring the water to any place in the drawer that is needed at this moment, so not only an analysis in the detecting means can be made but it is also possible to bring the water to filtering means provided in such a drawer.

Advantageously the filtering means can be arranged close to and behind a circulation pump of the washing machine, wherein this may be the regular and preferably only circulation pump. The advantage of this location is that the pump may be used not only to better direct a flow of water to a place wanted for analysis or even filtration, but potentially also for building up more water pressure than regularly needed in a washing machine if such should be needed for analysis or filtering or back-flushing of the filtering means.

It is preferably provided that the filtering means are accessible from outside the washing machine for manually removing filtered matter from the filtering means or for exchanging or just cleaning the filtering means, depending on their construction and/or use. This can take into account that the microfibers filtered out may not simply be flushed out of the washing machine into a sewage of a house, at least not if they have not been treated to be harmless.

The filtering means can preferably be located in a removable or extractable part of the washing machine for better access. The water circulation can lead with the branched-off part to such a removable or extractable part. It is preferably provided that the filtering means are located in an extractible and/or removable drawer for introducing detergent or additives for the washing process as described before, wherein in particular the filtering means are accessible via the drawer or after extracting of the drawer. This may provide for such a drawer that is almost a standard component of any washing machine to become a very important and functional part of a washing machine according to the invention. This can also take into account that, apart from such a drawer, a washing machine has not many places or spare space to provide an access to complex means such as the detecting means and/or the filtering means described before. It can also be made use of the fact that there is always a supply of fresh water to such a drawer. Furthermore, such a drawer usually is located in the upper part of the washing machine, preferably in the upper left part, where vibrations are least. Such a drawer may have at least three separate chambers, wherein there is provided a filtering means in a filtering chamber, at least one sensor chamber with a sensor means and an outlet out of the drawer or a drainage of the drawer. At least one detergent chamber may be provided for filling in detergents or additives for the regular washing process as is known for such a drawer.

There are many options for the details of how a filtering process can be performed. In one option, during a filtering process with the filtering means, water can be filtered with a decreasing aperture size of the filtering means over time. This means that at first a throughput of water is higher due to a bigger aperture size whereas only few microfibers are filtered out. Over the course of the filtering, the aperture size becomes smaller and smaller until, finally the smallest aperture size is reached. At this stage the water throughput is least, but it can be ensured that all or most microfibers are filtered out. The microfibers that have been filtered out already with larger aperture size can be collected up to then and removed.

Generally, an aperture size of the filtering means can be adaptable or adjustable for filtering microfibers of different size, so that a filtering process may be adapted to a size of microfibers detected in the water. Preferably the aperture size can be adjustable by the filtering means having two or even more filtering surfaces that can be stacked upon each other so that congruent filter pores may be displaceable with respect to each other. This displacement can reduce the aperture size of filter pores of the filtering means in total for better adapting the filtering degree to the microfibers detected or present in the water, respectively. The aperture size can also be adapted or adjusted for the back-flushing process of the filter, wherein preferably the aperture size is enlarged for easier and more complete back-flushing.

An aperture size or a pore width, respectively, can be reduced continuously or in steps during a filtering process with water circulating in the circulation through the filtering means. It can be provided, in certain time intervals, that the water to be filtered is passed over a different area of filtering surfaces for depositing filtered out microfibers on different areas of the filtering surfaces. This provided for a better efficiency of the filtering means by using the total surface of the filtering means. A change of the area of the filtering surfaces can take place corresponding to a step-wise reduction of the aperture size, so that different sizes of microfibers can be filtered out in different locations.

In a further embodiment, a pre-filter can be provided before the filtering means for the microfibers in the circulation. A pre-filter can be adapted to filter out articles with a size bigger than 2 mm in one direction, such as for fluff or lint. Such a pre-filter is often used in washing machines before the circulation pump. It is possible to arrange the filtering means for the microfibers close to the pre-filter with a distance of less than 10 cm between them. This may make it easier for a user to be able to empty both filters, preferably at the same time or at least at the same location. Alternatively a pre-filter can be provided close to the circulation pump.

In a further embodiment, the filtering means may comprise a structure of a separate body that can be inserted into the circulation, preferably directly into the drum, for filtering microfibers from the water. For this, the body may have a filter surface for the microfibers. The body can have a water inlet without any filtering, wherein a major part of its outer surface, preferably more than 50%, is constructed as a filter surface for filtering microfibers from water that has entered the body through the water inlet and is exiting the body via the filter surface. Such an independent and movable filtering means can provide for a very easy and efficient filtering. They can be released automatically by the washing machine in case microfibers have been detected, alternatively a respective signaling to a user can be provided for so that they are brought manually into the drum. After a washing procedure, the separate filtering means with the microfibers in it can easily be disposed of in a suitable way.

In a preferred embodiment, cleaning of a filtering means is provided for as to be able to remove filtered out microfibers from the filtering means other than by using a sewage water line, preferably in a lump. This is important if the filter is stationary or at least shall not be disposed of completely after a washing or a filtering procedure. Better filters can thus be used with higher efficiency and also a larger filtering surface to have a higher water throughput despite the filtering.

A cleaning of a filtering means may be provided for by implementing a transverse flow filtration, wherein the filtering means for such a transverse flow filtration can be provided with a filter surface having an aperture size or a pore width that in a first direction is small enough to hold back the microfibers in order to filter them out. In a second direction being transverse to the first direction, preferably at right angle, said pore width is larger than in the first direction, so that the microfibers can pass through and are not filtered out. A water outlet of the filtering means can be divertible with one diverting duct leading to a filtrate water tank or the like for collecting the microfibers, which may be removable from the washing machine or may have an outlet for emptying. So it is possible to use the filtering means with their filtering function by flushing them with water in the first direction, wherein the filtered water is directed back to the washing process or, if it corresponds to the washing program, to a sewage line and out of the washing machine to the sewage. If the filtering means are full or clogged with microfibers from the filtering function, respectively, they can be cleaned by flushing them with water in the second direction. Then the microfibers will pass the filtering means or the filtering surface, respectively, and can be collected in the filtrate water tank. From there, the collected microfibers can either be removed out of the machine or, alternatively, can be further treated for being easily disposed of in an ecological way, for example into a black water disposal.

In a further embodiment, the filtering means may have mechanical cleaning means that can be moved over or along a filter surface. These may be elastic mechanical cleaning means for better adaptation to a contour of the filter surface. The mechanical cleaning means can have a drive in the form of a motor, but they can also be driven by the water flow. This is another way not only to keep the filtering means operating but to collect and remove the microfibers filtered out of the water. The mechanical cleaning means can be arranged in such a way as to move the microfibers filtered out into a collecting chamber as mentioned before with the same options from then on.

The mechanical cleaning means may at least partly be made up of memory material, wherein a critical memory temperature for a shape change can be in a range between 40° C. and 90° C. This even allows for activating the memory material with the normal water used in the washing cycle. It may be provided that a pressing force of the cleaning means against the filter surface to be cleaned can be made adjustable via a temperature change in the temperature range. This allows for better and more individually adapting the pressing force as need may be.

As an alternative to memory material described above, a pressing force of the cleaning means against the filter surface may be adjustable from the outside via mechanical adjusting means or via an electrical drive. This allows for a presumably better and more precise adjusting.

In one embodiment, the filtering means can be provided with a round-cylindrical filter chamber, wherein a chamber wall can be made from filter material or have the filter surface. The water to be filtered will pass through the chamber wall in either of two directions. The cylindrical form provides for a rather large filtering surface area in relation to the size of the filtering means.

The mechanical cleaning means may comprise a screw-like comb that rotates with an axis of rotation congruent with the longitudinal central axis of the round-cylindrical filter chamber wall in order to remove microfibers filtered out from the water and being agglomerated on the filter surface from the filter surface. Due to the small aperture size of the filtering means, it is expected that the filtering surface needs a cleaning rather often to keep up a high filter throughput. Such a cleaning with a rotating screw-like comb may be continuous or at least in short intervals, for example every 5 sec up to every 30 sec.

The mechanical cleaning means may alternatively comprise a plunger with a linear movement, in particular with a linear movement along a longitudinal central axis of the chamber wall if the filter chamber is round-cylindrical as described before. This may provide for microfibers filtered out from the water and being agglomerated on the filter surface being removed from the filter surface to keep up a high throughput.

In a preferred embodiment the filtering means may comprise a collecting chamber for the microfibers that have been removed from the filter surface to be transported thereto. The microfibers can then be removed or destroyed effectively. The collecting chamber is advantageously connected to the filter chamber or to the filtering means, respectively. A connection may be provided at an end of the filter chamber and below it. In particular the collecting chamber may be accessible from outside the washing machine or may be extractable from the washing machine in order to remove the collected microfibers. Alternatively, the microfibers may be treated to become harmless, either by decaying or destroying or by clotting together to form larger particles or clots that can be easily filtered out in a sewage plant or in a pre-filter mentioned above. Such clots could also be flushed back into the water circulation after the washing drum and before the circulation pump to be caught in a pre-filter as described before or in a filter that is often used in a pump. In such clots, other fibers from the laundry such as organic fibers will most probably be present, potentially in a higher amount. These other fibers may be clotted together with the microfibers without any problem. They can even serve to make clotting easier due to the higher quantity of fibers resulting in bigger clots.

The filtering means may be provided in a filter circulation branch parallel to a circulation directly from the sump back into the drum via a pump. Valves can preferably be provided in the filter circulation branch before the filtering means, behind them and also in the circulation back into the drum before the drum on the one hand and between the connections to the filter circulation branch on the other hand. This provides for many options to direct a water circulation as wanted or needed for water to be filtered or not, depending on the result of the analysis. Also the option to clean the filtering means by back-flushing by directing a water flow in the reverse direction through the filtering means is valuable and interesting. This water with the microfibers in it can then be collected, for example in the collecting chamber mentioned before.

A lower end of the filtering means can be connected to an outlet with an outlet valve in order to activate a circulation of water through only the filter circulation branch, in case microfibers have been detected in the analysis to such an amount that filtering is deemed necessary. Then microfibers can be filtered out by the filtering means in a way described before.

An outlet out of the washing machine with microfibers in the water may be directed into the sewage of a house if the microfibers collected in the filtering means have been treated to clot together to a bigger size with a diameter of more than 2 mm. This can be according to a method as described before. Such particles or clots can be removed in a sewage plant. In this embodiment, a user need not be involved in cleaning the filtering means manually.

The filtering means may also have a filter chamber with at least two filter outlets. Before each of the filter outlets a filter membrane may be provided. A water inlet into the filter chamber is provided in order to filter water in the circulation from the sump back into the drum, wherein preferably an outlet to a sewage line is provided behind a lower filter membrane. This can ensure that water is filtered from microfibers before being directed into the sewage. In case of a washing machine which is provided with means for clotting the microfibers and flushing the clots into a sewage, such a second filter membrane is not necessary.

In a preferred embodiment, the filtering means can be cleaned by use of heat or by use of UV radiation, in particular against germs and microbes. This provides for a hygienic condition in the filtering means. This could also be implemented in any other chamber of a washing machine, especially in a collecting chamber where microfibers may be collected after filtering them out of the water. A cleaning may be provided in fixed intervals or in depending on how often they are used, potentially also depending on the results of the analysis for microfibers.

Preferably, microfibers collected in the filtering means can be treated for easier removing. Various treating means can be used for this, wherein preferably the microfibers are treated to clot to a bigger size as mentioned before. If they can be treated to clot to have a diameter of at least 2 mm they can be either filtered out easier or be flushed into the sewage as described before. Microfiber clots or balls of this size are not regarded as critical.

In an alternative embodiment, the clotted microfibers can also be collected in a collecting chamber mentioned before. They can be removed from this collecting chamber manually, preferably for disposal by a user after accessing the collecting chamber or removing the collecting chamber from the washing machine. This may even correspond to the removal of fluff collected in a laundry dryer which is also removed manually, it could for example be in a single-use cartridge or the like.

Optionally, a treatment may comprise a step with a thermal treatment of the collected microfibers, preferably for clotting them together also. Means for a thermal treatment may comprise introducing hot air or, preferably, hot water into the filtering means, for example with a temperature as mentioned above. This can easily be produced in a washing machine. Alternatively, radiation heat may be directly applied onto the microfibers collected in the filtering means or onto the filtering means or a mesh thereof, respectively. It can also be provided that the filtering means themselves may be heated if they are made of metallic or electrically conductive material. Also microwaves may be used for a heating.

The collected microfibers may also be treated chemically, for example by introducing chemical additives into the filtering means or bringing upon the filtered microfibers. They may clot or, alternatively, dissolve the microfibers chemically.

A treatment of the collected microfibers may also comprise a step with a bioremediation, preferably with bringing enzymes from an enzyme supply in the washing machine onto the microfibers or with bacteria from a bacteria supply in a similar way, respectively. The two can also be combined. This can in both cases lead the microfibers to dissolve and, consequently, be no more critical.

According to another option, a treatment of the collected microfibers may comprise a step with a mechanical treatment, preferably by pressing the microfibers together. This may also result in a clot of microfibers, which can be disposed of easily according to one of the options described above.

In a further embodiment of the invention, after detection of the presence of microfibers in the circulation water, in particular in case of exceeding a certain threshold for a percentage of microfibers in the water, the operation of the washing machine can be adapted by at least one of the following steps to reduce the generation or amount of microfibers in the water. This step of detection can then be made as soon as possible to be able to better adapt a following washing cycle.

It is possible to adapt or lower, respectively, a rotational speed of the drum. Due to this reduction the abrasive effect onto the laundry is lowered resulting in less microfibers in the water. The temperature of the water in the circulation may be adapted or lowered, respectively. This also reduces generation of microfibers out of the laundry.

At least one specific additive may be introduced into the water circulation for changing a pH-value of the water in the circulation. A similar effect is achieved by introducing at least one additive into the circulation for enhanced decalcification. Both do result in less abrasion of the laundry for reduced generation of microfibers. Another optional step is introducing a friction-reducing surfactant into the circulation, preferably a bio-degradable surfactant, with a similar result. Finally, it is possible to change a detergent used in the washing process, preferably from powder form to liquid form fur reducing abrasionial effects.

These and further features are evident not only from the claims but also from the description and the drawings, the individual features each being implemented by themselves or in multiples in the form of subcombinations for an embodiment of the invention and in different fields and being able to be advantageous and independent protectable embodiments for which protection is claimed here. The division of the application into individual sections and subheadings does not limit the general validity of the statements made thereunder.

BRIEF DESCRIPTION OF THE FIGURES

Exemplary embodiments of the invention are schematically represented in the drawings and will be explained in more detail below. In the drawings.

DETAILED DESCRIPTION OF VARIOUS EMBODIMENTS

Figure 1:
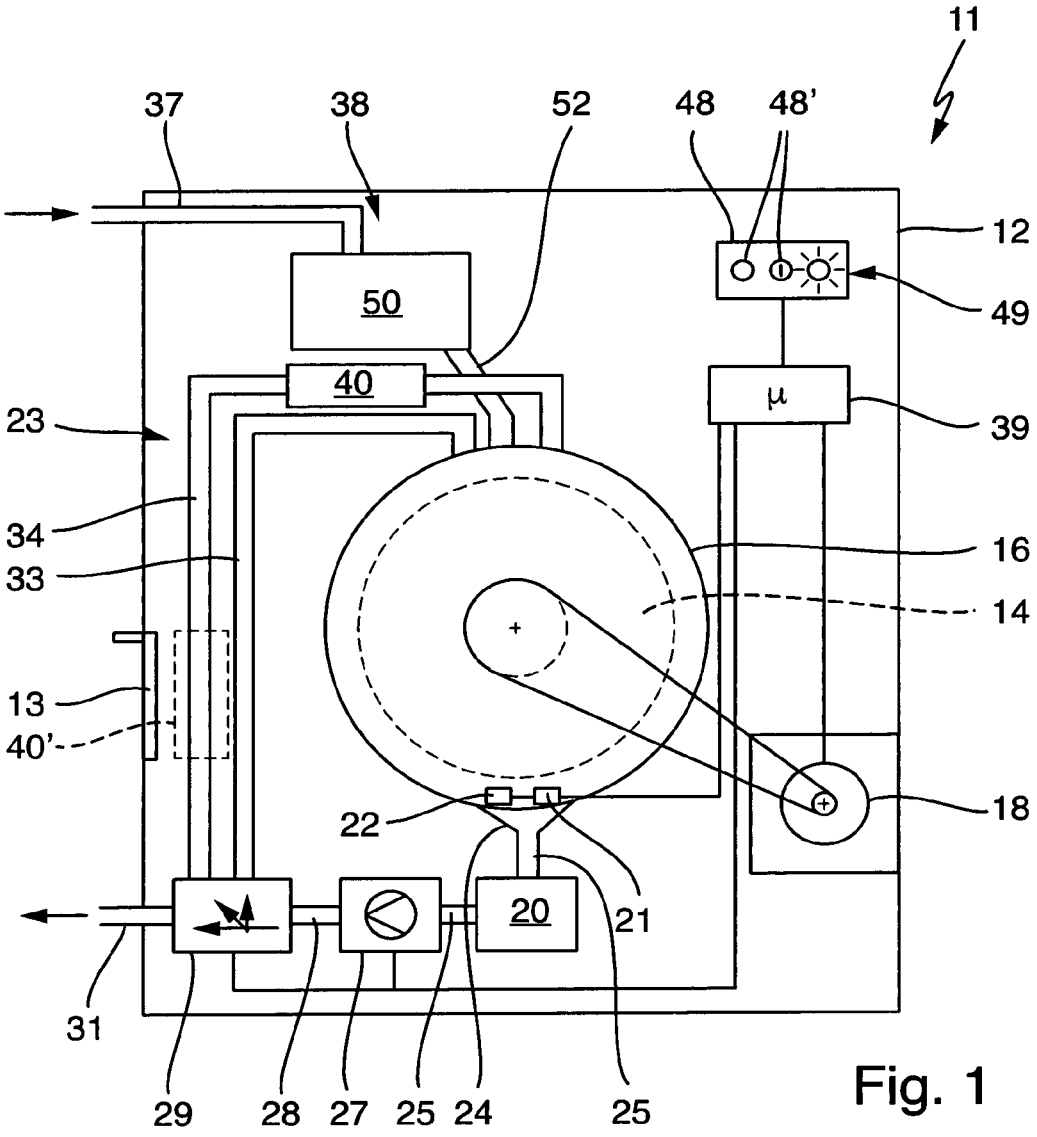
FIG. 1 shows a schematic view of a washing machine according to the invention with a conventional water circulation which, additionally, contains detecting means and a filter for microfibers.

FIG. 1 represents a schematic view of a washing machine 11 according to the invention. Washing machine 11 has a housing 12 including a drum 14 in a drum housing 16. A drive motor 18 is provided for drum 14. On the lowest region of drum housing 16 or in a sump 24 underneath leading out of drum housing 16, a heater 21 together with a temperature sensor 22 for controlling operation of the heater 21 are provided. Furthermore, a water circulation 23 is provided which is partly according to the prior art.

From sump 24 a sump pipe 25 leads at first to detecting means 20 according to the invention for detecting microfibers in the water of water circulation 23. The detecting means 20 can be designed such that a small amount of water is branched off for being analyzed, whereas the main part of the water is transported in conventional manner via sump pipe 25 to a pump 27. This pump 27 corresponds to the usual circulation pump in a conventional washing machine. The branching off of water for an analysis is necessary to have sufficient time for a thorough analysis, because an analysis for microfibers directly in fast flowing water is difficult or even impossible.

Detecting means 20 may be at any other location in washing machine 11. This becomes clearer in the embodiment according to FIGS. 6 and 7 described later on, where detecting means 20 are provided in drawer 50.

From an outlet of pump 27, a pump pipe 28 leads to a valve device 29, which is a so-called three-way-valve. In a first position, valve device 29 connects to a sewage line 31 out of the washing machine 11 leading into a sewage of a house or the like. In a second position, valve device 29 is connected to a circulation pipe 33 which leads back to the drum housing 16 such that circulating water enters drum housing 16 from above for participating in the washing process in drum 14.

According to the invention, a third pipe in the form of filter pipe 34 is provided which leads from valve device 29 in its third position to a filter 40 and, from filter 40, back again into drum housing 16 in a manner corresponding to circulation pipe 33. Filter 40 is designed to filter microfibers from the water as described before in general. Further details regarding filter 40 will be described later on.

An alternative location for a filter for microfibers may be filter 40' located shortly above valve device 29 and closer to the pump 27, but could also be placed between pump 27 and valve device 29. Housing 12 may be provided with a door 13 providing access to filter 40', which is represented in dashed lines. This serves for cleaning filter 40', especially from microfibers collected in there, or for replacing filter 40'.

Washing machine 11 also has a control device 39 corresponding partly to a conventional control device for a washing machine. Control device 39 is connected to heater 21 and temperature sensor 22, detecting means 20, pump 27 and valve device 29. Furthermore, control device 39 is connected to a conventional operating device 48 with operating elements 48' together with a lamp 49, which could also be any other optical signaling means or a display. Other sensors for the direct control or surveillance of the washing process could be provided as well.

Finally, washing machine 11 is provided with a fresh water pipe 37 for delivering fresh water to the washing machine 11 and to a washing process, respectively. This fresh water from fresh water pipe 37 enters a dispensing system 38, which in this case is a drawer 50 that may correspond to a conventional drawer of a washing machine according to the prior art. Drawer 50 being arranged in the upper left area of the washing machine 11 will be described later. From drawer 50, a drawer outlet 52 leads again into drum housing 16. In drawer 50, detergents and additives for a washing process are inserted by a user of washing machine 11 and are flushed with the help of fresh water from a fresh water pipe 37 into drum 14 for the washing process. This corresponds to a conventional washing machine. Fresh water pipe 37 may be provided with several valves that are controlled by control device 39 to deliver fresh water into one of several chambers, which is also known in the art.

For a first general description of the invention, the detailed embodiment and function of detecting means 20 and filter 40 are not necessary. In a washing process in washing machine 11 initiated by a user via operating device 48 that has started in a conventional way, water exiting from sump 24 after being in contact with laundry in drum 14 is passing by the detecting means 20 in the sump pipe 25. As the task of analyzing water to see if microfibers are present in the water at all, and preferably also the amount of microfibers, is critical and crucial, it is regarded as advantageous to take some time. This analysis cannot be done on water flowing through sump pipe 25 or any other part of water circulation 23, so it is rather preferred to have some more time. In any way, if detecting means 20 come to the result, after having analyzed the water, that more than a critical percentage of microfibers is present in the water, they trigger control device 39 to take some kind of countermeasure, in this case to activate filtering the water for microfibers. This happens by control device 39 activating valve device 29 in a way that the water circulation 23 is not exclusively via circulation pipe 33 back into drum housing 16, but to additionally, preferably exclusively, use filter pipe 34 in which filter 40 is arranged. In this preferred way, all the water circulating in water circulation 23 is being filtered in filter 40 to remove as much microfibers as possible.

Such an activation of the filter 40 via control device 39 and detecting means 20 has the advantage that the information if microfibers are or may be present in the water does not need to come from a user, thereby excluding a potential source of errors. This is not only because a user may interpret any tags in the laundry in a wrong way, but it does also cover cases where there is simply no identification of the kind if fibers of a piece of laundry. So the risk of polluting water with microfibers is in fact minimized. Activating filter 40 only in a case where microfibers are present in the water, which means that this is only in a case where filtering is definitely necessary, has the advantage that filter 40 need not be activated all the time. This again serves for a longer life of filter 40 as well as a higher efficiency in the water circulation 23 if filter pipe 34 and filter 40 are not participating in the water circulation process.

As has been explained before, apart from activating filter 40, control device 39 can provide for additional countermeasures against microfibers potentially polluting sewage water. This is for example having drum 14 rotate with lower speed, which again lessens mechanical impact on the laundry such as abrasion or the like, which in consequence also reduces the amount of microfibers in the water in water circulation 23. Furthermore, a temperature of the water circulating in washing machine 11 may be changed via changing operation of heater 21 to reduce microfibers in the water.

As a further option, special additives may be given into the laundry in drum 14 via fresh water entering the drawer 50 in a special additive chamber directed to this purpose. Such special additives, for example softening agents, may reduce internal friction in the fibers and the fabric of the laundry in drum 14. It should, however, be noted that even in view of such countermeasures, irrespective of how successful they are, a core aspect of the invention is filtering the water with filter 40 to remove any microfibers contained therein.

If filter 40 is used up or microfibers and other filtered matter must be removed, there are basically the options as explained above. One obvious option may be the provision of filter 40' at its position behind door 13 in the housing 12. By opening door 13, filter 40' can easily be cleaned or removed for an outside cleaning from microfibers, wherein afterwards filter 40' is put back into its location in filter pipe 34. Other options for cleaning a filter from microfibers as well as removing the microfibers are described hereinafter.

If no microfibers are detected in the water during the washing, the rinsing or the spinning cycle of laundry in washing machine 11, the filter 40 need not be activated and, in the case of the washing machine 11 according to FIG. 1, filter pipe 34 may be simply shut off by valve device 29.

Figure 2:
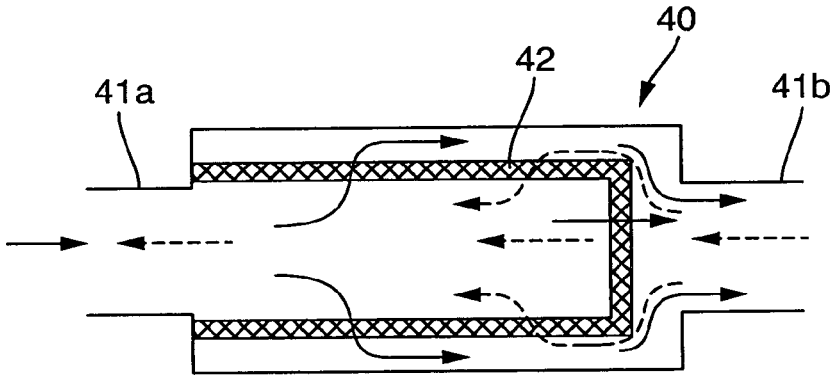
FIG. 2 shows a first embodiment of a filter for microfibers.

In FIG. 2, a first embodiment of a basic form of a filter 40 is shown. Filter 40 has a filter housing with a filter inlet 41*a* and a filter outlet 41*b*. Inside the housing of filter 40, a filter membrane 42 as the filter surface described before is provided, for example in cylindrical form with a large surface. It can also be provided in any form, for example in folded form for enlarging a filter surface. Water entering via filter inlet 41*a* passes through filter membrane 42, whereby microfibers are held back and agglomerate on the inside of filter membrane 42. After having been filtered to remove microfibers, the filtered water may exit from filter 40 via filter outlet 41*b*.

If filter 40 or filter membrane 42, respectively, needs cleaning from filtered out microfibers, this may be either done at regular intervals which may be signaled via lamp 49 to a user on operating device 48. Alternatively, conventional measuring systems may be used for this, for example with pressure sensors or throughput sensors in the water circulation and particularly in filter pipe 34 before filter 40 and after it. If a filtering efficiency is too low or if the amount of water passing filter 40 is not sufficient, filter 40 needs to be cleaned from filtered matter. This may be done manually, for example via door 13 in the position of filter 40'. Alternatively, filter 40 may be in any other location which may be easily accessible for a user.

In dashed lines, arrows showing the back-flushing of filter 40 can be seen. The water exiting filter 40 through filter inlet 41*a* must then be freed from the microfibers and other fibers that have been detached from the inside of filter membrane 42.

Figure 3:
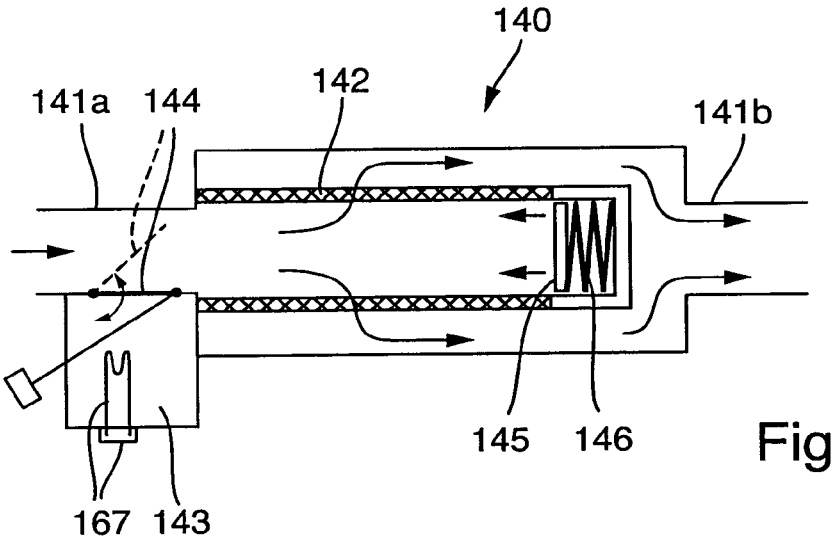
FIG. 3 shows a second alternative embodiment of a filter similar to FIG. 2 with cleaning means for the filter in the form of a pusher and a collecting chamber for microfibers.

Another option of a way to clean a filter is shown in FIG. 3, where a second embodiment of a filter 140 is provided with a filter inlet 141*a*, a filter outlet 141*b* and a filter membrane 142 inside. At filter inlet 141*a* and beneath it is provided a collecting chamber 143 which can be closed with a controllable flap 144. Flap 144 can be rotated from its horizontal position shown in FIG. 3 to a lower position in an anti-clockwise direction, thereby opening collecting chamber 143.

Inside filter membrane 142, a plunger 145 is provided, for example with a plunger spring 146. Plunger spring 146 may be pressed together by plunger 145 due to the water pressure of water entering filter inlet 141*a*, thereby enabling a maximum surface of filter membrane 142 to filter out microfibers from the water. If the water flow stops, plunger spring 146 pushes plunger 145 to the left and towards filter inlet 141*a*. Plunger 145 is designed as to fit snuggly into filter membrane 142 and against its surface, thereby having the effect that microfibers and other filtered matter collected on the inner surface of filter membrane 142 are scraped off from this surface and moved to the left. If flap 144 is open, collecting chamber 143 is also open and plunger 145 may push the filtered matter into collecting chamber 143. After that, flap 144 may be closed again and, although plunger 145 is in a left position, filter 140 is ready for filtering again in such a way that when water is circulated in water circulation 23 via pump 27, the plunger 145 will be pressed by the water to the right against plunger spring 146, thereby enabling all of the surface of filter membrane 142 to work as a filter.

For implementing such a method, it can be provided that the control device 39 of washing machine 11 opens flap 144 as soon as the water circulation through filter 140 stops, which may for example be because pump 27 is stopped or because valve device 29 has shut off filter pipe 34.

Collecting chamber 143 may be accessible from outside, for example via door 13 according to FIG. 1 or via drawer 50, to remove the filtered matter to be put into the household garbage. As an alternative to removing the microfibers from collecting chamber 143, the microfibers may be subjected to a treatment to make them harmless. One option for such a treatment would be with a bioremediation in collecting chamber 143, which means that the microfibers and potentially and other filtered matter might be decomposed, decayed or dissolved via bacteria on the one hand or via special enzymes on the other hand. These bacteria or enzymes may additionally be dosed into collecting chamber 143 depending on the amount of microfibers collected therein. After this process is finished, the remnants may either be flushed out of collecting chamber 143 with water or be removed manually.

As a further option, the microfibers may be clotted to a bigger size, for example either by the action of plunger 145 or by other mechanical means, which may also be provided inside collecting chamber 143. If the microfibers have been clotted to a bigger size, for example with a diameter of 2 mm or more, they may either easily be removed by a user or, alternatively, might be flushed out of collecting chamber 143 and be directed to sewage line 31 out of washing machine 11. Particles of such a size can be filtered out in conventional sewage plants, which also provides for a removal of the microfibers from water.

As a further alternative, the microfibers may be treated in collecting chamber 143 by heat, for example by radiation heat with heater 167 or with microwaves. This may also serve to clot the microfibers and potentially any other fibers together or to even melt them into a larger chunk with a size as described before, which again may be removed as an option in a sewage plant as described before. Heater 167 may also serve to dry collecting chamber 143.

As a further way to treat microfibers in the collecting chamber 143, chemical additives may be given onto the microfibers to also clot them together to bigger chunks or, alternatively, to dissolve them. This, however, needs particular attendance to make sure that, if the chemical additives are to be flushed into a sewage line of washing machine 11, they themselves are not hazardous to the environment.

Figure 4:
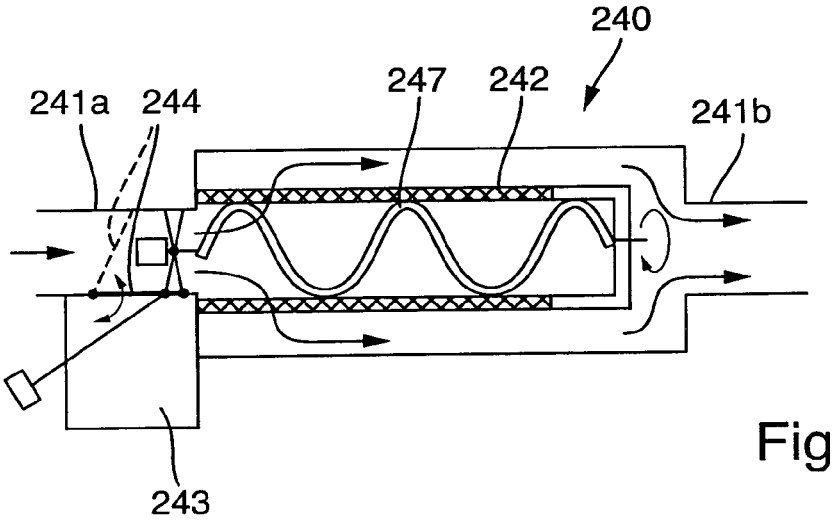
FIG. 4 shows a third alternative embodiment of a filter similar to the filter of FIG. 3 with cleaning means in the form of a rotating screw to transport microfibers into a collecting chamber.

Another alternative for cleaning a filter is shown in FIG. 4 with a filter 240, again having a filter inlet 241*a* and a filter outlet 241*b*. A filter membrane 242 is provided as in FIGS. 2 and 3. A rotatable cleaning screw 247 is provided which is rotated by a separate drive. Furthermore, a collecting chamber 243 with a flap 244 is provided, which corresponds to the one of FIG. 3 and, thus, is not described in further detail.

To remove microfibers from the filtering surface on the inside of the filter membrane 242, cleaning screw 247 is rotated in such a way as to continuously move or push microfibers towards collecting chamber 243. This may either be done already during a filtering phase or preferably after a filtering phase, when flap 244 to collecting chamber 243 can be easily opened due to the lack of water flow through filter 240.

Other potential cleaning means may include a memory metal or a memory material in general, which may transform due a temperature change, either by explicit heating or by hot water flowing over the cleaning means. This serves for effecting a movement of the cleaning means to clean the filter surface as described before for the cleaning means with the plunger and the screw.

Figure 5:
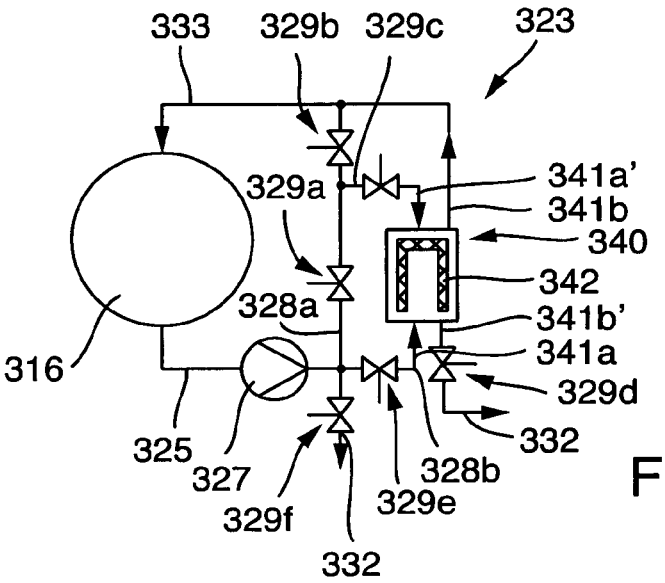
FIG. 5 shows a schematic view of a part of a water circulation of the washing machine with a pump and several valves to enable filtering of water with a filter and cleaning of the filter by backwashing.

FIG. 5 shows another option for a water circulation 323 in a washing machine. A sump pipe 325 connected to drum housing 16 leads to a circulation pump 327. Behind pump 327, a first pump pipe 328*a* leads upwards to a valve 329*a*, a crossing and via another valve 329*b* to a circulation pipe 333. This circulation pipe 333 leads into drum housing 316 as described before.

A second pump pipe 328*b* leads via a valve 329*e* into a filter inlet 341*a* of filter 340 with a filter membrane 342 as roughly indicated. A filter outlet 341*b* leads to circulation pipe 333 and into drum housing 316 as described before.

Between valves 329*a* and 329*b*, a short pipe branches off with another valve 329*c*, which leads into filter 340 at another filter inlet 341*a'* or, as an alternative, via filter outlet 341*b*. A further filter outlet 341*b'* is connected via a further valve 329*d* to an outlet line 332. Outlet line 332 may lead out of the washing machine for water or the like to be collected with a bucket or in a similar receptacle. Alternatively, it can lead to a tank inside the washing machine for further treating microfibers and other filtered matter as described before with regard to FIG. 3. Valves 329*c* and 329*d* as well as additional filter inlet 341*a'* and filter outlet 341*b'* serve to enable backflushing of filter 340 with filter membrane 342 for cleaning purposes.

By opening both valves 329*a* and 329*b*, water flow can be directed behind the pump 327 in a path directly into circulation pipe 333 and back into drum housing 316. Valves 329*c* and 329*e* are then preferably closed. This is being done if no microfibers are detected in the water or, respectively, if filter 340 shall not be used. If both valves 329*a* and 329*b* are closed and valve 329*e* open, water pumped by circulation pump 327 flows via filter inlet 341*a* into filter 340, is being filtered therein and flows via filter outlet 341*b* into circulation pipe 333. This path is used when the water shall be filtered from microfibers or the like.

If filter 340 shall be backflushed, valves 329*a*, 329*c* and 329*d* are opened, whereas valves 329*b* and 329*e* are closed. Water flow from pump 327 then enters filter 340 via filter inlet 341*a*' and flows through filter membrane 342 in the opposite direction, thereby removing microfibers and other filtered matter from the inside of filter membrane 342 such that they are flushed out of filter 340 via filter outlet 341*b*' and through valve 329*d* to outlet line 332. Another valve 329*f* is located behind pump 327, which also leads to outlet line 332. This is for the disposal of water from the pump 327 via outlet line 332, for example if no microfibers have been detected in the circulating water. In this case no filtering is needed and is not put into effect.

As can readily be seen from FIG. 5, valves 329*a* and 329*e* as well as valves 329*b* and 329*c* may in each case be replaced by two-way-valves or the like for directing water flow in either one of two directions, similar to the three-way-valve device 29 of FIG. 1.

From FIG. 5 it can also be taken that it may be advantageous to arrange filter 340 shortly behind the circulating pump 327.

Figure 6:
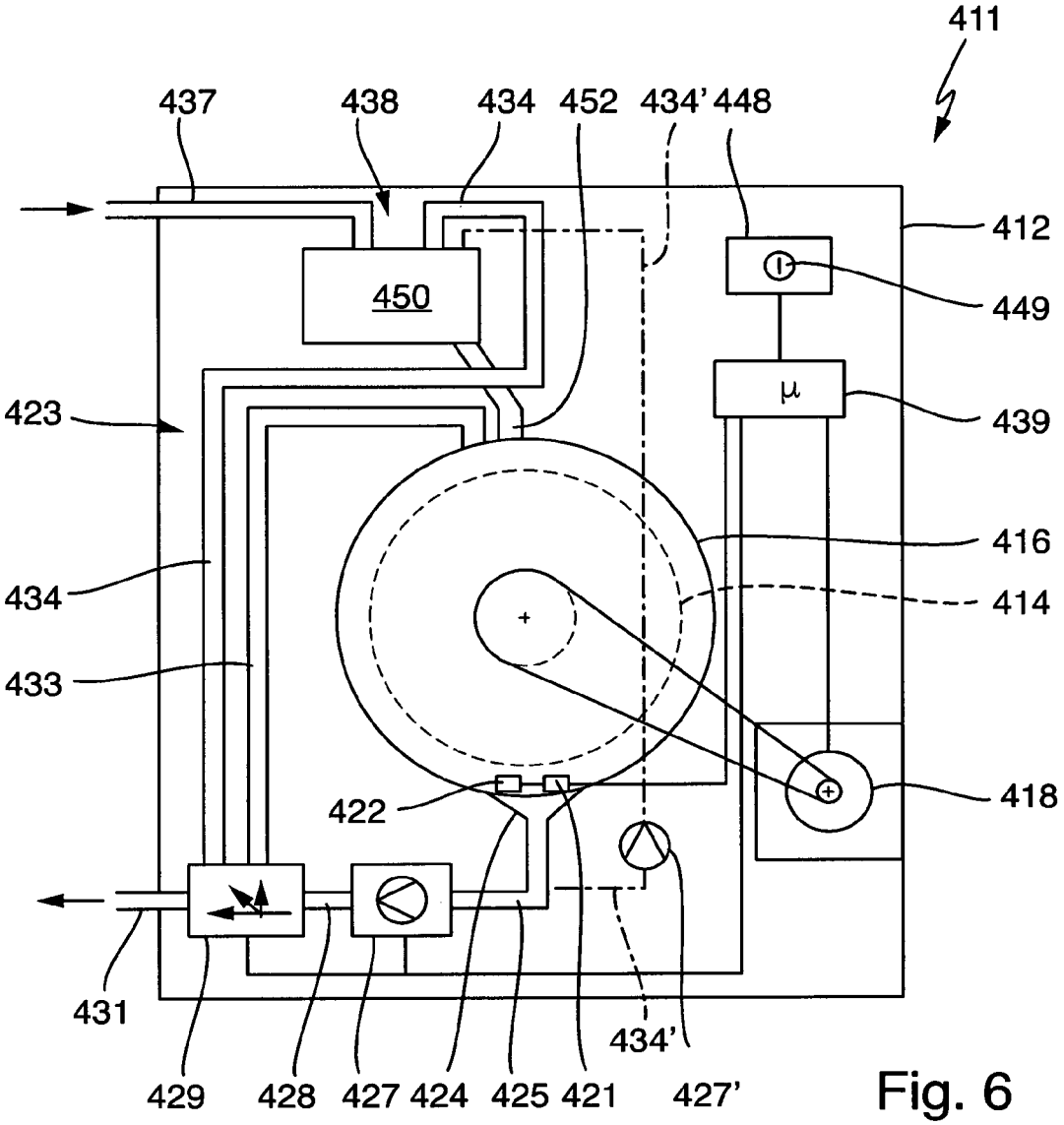
FIG. 6 shows an alternative embodiment of the washing machine of FIG. 1 with detecting means and the filter in a drawer also used for dosing detergents and additives into the washing process.

In FIG. 6, a further alternative washing machine 411 is shown with a different location of detecting means for the microfibers and of a filter for the microfibers. Basically, the construction of washing machine 411 is similar as to FIG. 1 having a housing 412 with a drum 414 for the washing process, being arranged in drum housing 416 and having a drive motor 418. At the bottom of drum housing 416, and shortly above or in a sump 424, a heater 421 with a temperature sensor 422 is provided. A sump pipe 425 leads to a pump 427, which again leads with a pump pipe 428 to a three-way-valve device 429. From valve device 429, one outlet is to a sewage line 431. Another outlet is via circulation pipe 433 directly into drum housing 416. This path serves for circulating water during a washing process without any filtering or detecting whether microfibers are present.

A third outlet leads via filter pipe 434 of water circulation 423 into a drawer 450, which in this case is a drawer according to the invention as described before. A fresh water pipe 437 from outside also leads into drawer 450. Together they all form a dispensing system 438.

In the drawer 450, not only chambers for detergents and additives used for a conventional washing process are provided, which detergents and additives can be flushed with fresh water from fresh water pipe 437 and a drawer outlet 452 into drum housing 416 for the washing process. Also detecting means and a filter are provided therein. In a further preferred embodiment of the invention, drawer 450 may also contain a control or electronics, preferably a microcontroller, for evaluating the detecting means and potentially communicating with a control device 439 of the washing machine 411. In an even more preferred embodiment, a control device or microcontroller directly arranged in drawer 450 may overtake a major part or all of the control functions of washing machine 411.

An alternative embodiment of a filter pipe 434' being represented in dashed-dotted lines is shown on the right side of drum housing 416. It is provided with its own pump 427', so that pump 427 may exclusively be for the circulation. In such an embodiment a conventional construction and design of a washing machine may be used, and the parts and components for implementing the invention are then only added or additionally mounted in the housing 412 of washing machine 411. So security measures or standards may be kept in any way. Pump 427' and filter pipe 434' are leading directly from sump 424 into the drawer 450. So a filtering process is independent from the washing process, wherein both processes can especially take place simultaneously. Pump 427' and filter pipe 434' may be combined in a kind of module which is fitted into an existing washing machine design.

Figure 7:
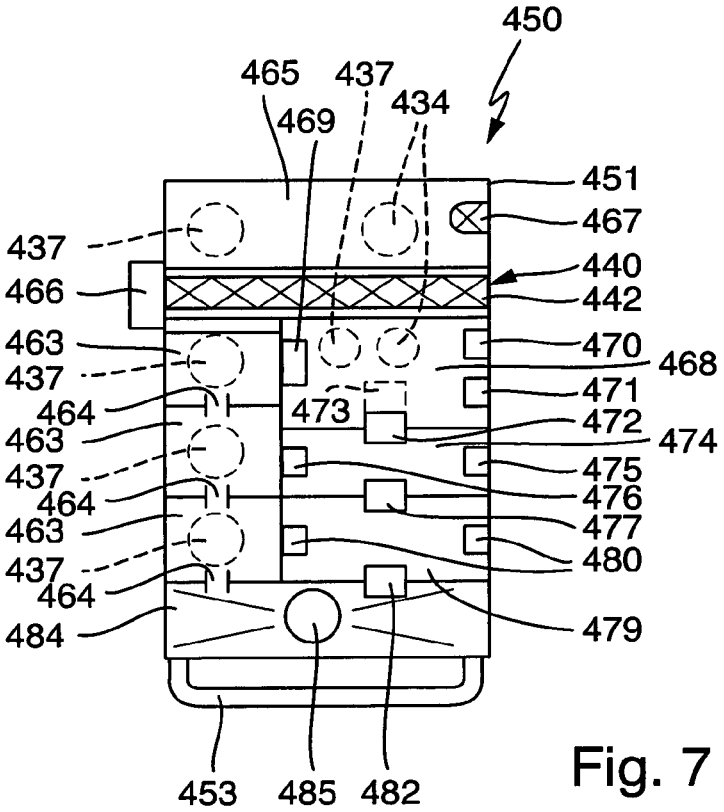
FIG. 7 shows a schematic view from above onto the drawer of FIG. 6 with a filter, several chambers and several sensors.

FIG. 7 schematically shows an exemplary embodiment of drawer 450 having a drawer housing 451. In the front part, a grip 453 is provided for extracting drawer 450 out of housing 412. Drawer body 451 is provided with a plurality of chambers and also water inlets. Water inlets are, on the one hand, represented in dashed lines as fresh water inlets 437 in several locations. On the other hand, filter pipe inlets 434 are also provided in several locations, also represented in dashed lines. Diverting a water flow between these various inlets is not shown here, but can easily be done via valve devices or the like. Especially for fresh water from fresh water pipe 437, valve devices or the like being used in conventional washing machines may preferably be provided. The same applies to water from filter pipe 434, which is circulating water being pumped by circulation pump 427.

In a front left region of drawer 450, three detergent chambers 463 are provided in one row being connected via openings in such a way that water entering one of these chambers flows in any case with the aid of a downward slope not represented here to the foremost detergent chamber 463. From there, finally, the water flows into an outlet chamber 484 having a siphon outlet 485 or the like, which again leads into drawer outlet 452 and back into drum housing 416. The number of detergent chambers 463 could be higher or lower. They can be used for filling in detergents as well as additives like softeners or the like, as is known from conventional washing machines. Each of these detergents and softeners are flushed into the washing process as they are required in a conventional manner.

In the back part of drawer body 451, a filter chamber 465 is provided with two water inlets, namely one from fresh water pipe 437 and one from filter pipe 434. A filter 440 is provided with a filter membrane 442, which forms a kind of filter outlet from filter chamber 465. Filter 440 with filter membrane 442 can be of any kind as described above, preferably a conventional filter surface being able to filter microfibers with a size of down to 1 μm or 2 μm from water.

To be able to clean filter chamber 465 as well as filter 440 from germs and microbes, at least one UV lamp 467 can be provided. Another such UV lamp or a similar device can be provided on the other side of filter membrane 442.

For adapting an aperture size or the size of the filter pores of filter membrane 442, respectively, an actor 466 is provided, here being shown on the left side of filter 440. This actor can compress filter membrane 442 to reduce the pore size or aperture size, respectively, especially for the filtering process to be more thorough. Alternatively, it can draw filter membrane 442 to enlarge a pore size, for example for back-flushing the filter 440. It is easily imagined that actor 466 could instead be used to rotate cleaning screw 247 of FIG. 4.

Filter 440 can also be provided with any filter cleaning means as described in the introductory part of the description, for example with mechanical plungers or scrapers or combs or the like. Furthermore, filter 440 or filter membrane 442, potentially also together with filter chamber 465, may be designed to be removable from drawer 450 to be extracted for emptying its content into the household garbage or the like. Filter 440 with filter membrane 442 may also be a disposable filter for a complete removal together with filtered matter, wherein a new filter may be inserted afterwards for further use of the washing machine 411.

Behind the filter 440, the filtered water enters a reactor chamber 468 being provided with a special additive supply 470, a heater 469 and a sensor 471. Above reactor chamber 468, a fresh water pipe 437 and a filter pipe 434 are represented in dashed lines to show that filter 440 can somehow be by-passed for direct use of reactor chamber 468 and the following chambers if filter 440 is not or not yet needed or if it is flushed back for cleaning purposes.

The special additives in special additive supply 470 may be special detergents as enzymes or the like, which can be activated by heat from heater 469 or in some other manner. They may be of great use in specific washing procedures depending on the kind of laundry and the kind of pollution on the laundry. Furthermore, such special additives might serve for the purpose of laundry being made up of synthetic fibers reducing an output of microfibers, for example by reducing internal friction in the fabric of the laundry. Even if reactor chamber 468 is not used, circulating water may be introduced therein to by-pass filter 440.

A valve 472 may open a water flow from reactor chamber 468 into the next chamber being a processing chamber 474. In processing chamber 474, processing means 475 are arranged on one side, and a sensor 476 is arranged on the other side. The processing means may include a heater or a radiation source, particularly for treating water, contamination in the water or, especially, microfibers or other textile fibers in the water. The sensor 476 may be designed to monitor such a treatment or its results, respectively, for better controlling it. Such a water flow may be achieved as in the detergent chambers by a downward slope in the chambers on the right side.

Through a further valve 477, the water may flow from processing chamber 474 into a detecting chamber 479 in front of it being provided with two sensors 480 and being closed by another valve 482. In detecting chamber 479, the main detecting process for detecting microfibers in the water circulating in washing machine 11 or, respectively, in water circulation 423 takes place. Sensors 480 may be of any kind as described before, preferably they are a sedimentation analysis sensor such that detecting chamber 479 corresponds to sedimentation chamber as mentioned in the introductory part of the description. For such a sedimentation analysis, water from the water circulation 423 in washing machine 411 may be introduced via filter pipe 434 and open valves 474 and 477 into detecting chamber 479, whereas valve 482 is closed. If detecting chamber 479 is filled up to a certain degree or for a certain time, valve 477 is closed and valve 482 may either be slightly opened to let out some water or, even better, a certain amount of time is let pass until fibers and other matter in the water in detection chamber 479 can sink down as provided and as known in the art. Sensors 480 may then detect in the conventional manner whether microfibers are present at all and, in addition, may try to detect whether the pollution of the circulating water with microfibers is rather low or rather high, in particular when compared to other fibers present in the water and, in consequence, also in detection chamber 479. Sedimentation analysis sensors together with optical sensors are best used for this, naturally not excluding other suitable sensor means.

Such a detection process may take some minutes. The big advantage of the invention of providing the detecting means with sensors 480 for detecting microfibers in drawer 450 is that the location of drawer 450 in the upper part of housing 412 is the location in washing machine 411 with the least amount of vibrations and mechanical interference. Consequently this has been proven to be the best location for not only sedimentation analysis sensors, but also for other sensors that may be used for detecting pollution or microfibers in water. Due to their easy accessibility the sensors can also easily be cleaned or replaced manually. Furthermore, an advantage of also providing the filter 440 in drawer 450 is that also filter 440 is easily and readily accessible in drawer 450. Apart from drawer 450, a conventional washing machine only has one small opening in a lower area of the housing, preferably for completely emptying the water circulation in the washing machine from water. By arranging the filter 440 in the drawer 450, in contrast to the embodiment of FIG. 1 with a potential additional door 13 for cleaning filter 40', there is no need to change much in the basic construction principle of the washing machine. Cleaning of filter 440 as well as potentially replacing it is very easy and comfortable for a user.

For the time that the analysis of water in detecting chamber 479 takes, the water circulation should continue in a conventional manner via circulation pipe 433 back into drum housing 416 as fits to the washing process started. It should only be paid attention not to release any water into sewage line 431 out of washing machine that has not been filtered due to potentially containing microfibers. If the result of the analysis of the water is that microfibers are present, and, in particular, with an amount that a filtering is recommended or mandatory, such filtering will then start. This means that valve device 429 shuts off circulation pipe 433 and directs a flow of water through filter pipe 434 into drawer 450, in particular into filter chamber 465 with the filter 440. Valves 472, 477 and 479 are then opened such that filtered water can flow through the respective chambers into outlet chamber 484 and through siphon outlet 485 via drawer outlet 452 into the drum housing 416 where it continues the washing process.

It can readily be seen that in an adaptation, UV lamp 467 may be replaced by any means as described before to clot microfibers filtered out together to a bigger size, for example a radiation heater. As an alternative, there may be provided means for a bioremediation as described before. It is also possible to clean or flush detecting chamber 479 with circulating used water or with water from filter pipe 434 or from fresh water pipe 437, preferably entering into reactor chamber 468, and a corresponding opening and closing of valves 472, 477 and 482.

In another option, fresh water from fresh water pipe 437 may be analyzed by a sensor provided in the drawer to be able to determine, for example, content of contamination or a degree of water hardness. This could also be implemented to analyze grey water coming into the machine before it is let into the drum. A rinsing or cleaning of all the sensors with fresh water may also be used to calibrate these sensors for better accuracy.

In addition, a pre-filter may be provided at least before detecting chamber 479, preferably at the location of valve 472. Such a pre-filter 473 as shown in dotted lines serves for the purpose of pre-filtering water entering processing chamber 474 and, especially, detecting chamber 477 from any matter that might falsify analysis of the water for microfibers. Such a pre-filter is preferably adapted for filtering out larger particles such as fluff or lint. The location of pre-filter 473 in drawer 450 also provides for easy access and easy cleaning or replacing it. In an alternative embodiment, such a pre-filter or a further pre-filter may be arranged close to pump 427 with the additional purpose of protecting pump 427 from such bigger particles, preferably before pump 427.

Other embodiments of filter 440 can of course be provided in a washing machine according to the invention for a method according to the invention as described in the introductory part of the description. Such filters may especially be adapted for a transverse flow filtration or may have an adjustable aperture size of a filter membrane. Basically, such diverse filters are known in the art and can readily be provided in the invention, particularly in a drawer 450 as shown in FIG. 7.

The start of a filtration of circulating water for microfibers can, if such microfibers have been detected, in each case be initiated by control 39 or 439, respectively. In practice, it is regarded as sufficient if water is analyzed a short time span after the washing process of laundry has started, especially one or two minutes after the first rinsing of the laundry with water when it can be expected that any synthetic fibers in the laundry have set free microfibers that are to be filtered out according to the invention. If such an amount of microfibers has been detected in one washing process, it can obviously be taken that microfibers will be released during the complete washing process, which leads to the filtering being advisable during the complete washing process. In consequence, only water that has passed through the filter 440 may be pumped out of the washing machine via sewage line 431. Depending on the nature of the filter 440, one filtering step may be sufficient or, alternatively, several filtering steps are needed such that, during an end phase of the washing cycle as well as of the spinning cycle before releasing water out of the washing machine, water may be circulated over the filter only for the purpose of filtering and not because it is needed for the washing process.

The invention claimed is:

1. Method for operating a washing machine, wherein:

the washing machine comprises:

a drum for conducting a washing process therein, a sump located underneath the drum for collecting water exiting the drum, a water circulation system including at least one of an extractible or a removable drawer for introducing detergent or additives for the washing process, the water circulation system being in fluid connection to a detecting means for detecting microfibers in the water, and a circulation pump for circulating water in the water circulation system, and the method comprises the steps of:

branching off an amount of water circulating in the water circulation system and transporting it to the detecting means to be analyzed, analyzing the water in the detecting means, and depending on the result of this analysis, activating a filtering process with a filtering means for filtering out the microfibers from the water.

2. Method according to claim 1, wherein in a step before activating the filtering process, a differentiation is made between different types of fibers.

3. Method according to claim 2, wherein the differentiation is being made with sensors in the detecting means.

4. Method according to claim 3, wherein the sensor forming said detecting means is one of: an optical sensor, an opacimeter sensor, or a spectrometer sensor.

5. Method according to claim 1, wherein the detecting means has a filter chamber with a filter for filtering out particles from the water to be analyzed and/or has a sedimentation chamber for particles from the water to set down in for analysis of the sediment.

6. Method according to claim 1, wherein the filtering process for the filtering means for filtering out microfibers from the water is activated at least twice or for two periods during a complete washing cycle.

7. Method according to claim 1, wherein only a fraction of the water circulating in the water circulation system is branched off and introduced into or transported to the detecting means for analysis.

8. Method according to claim 1, wherein the detecting means is located in a region of the washing machine with less than average vibration.

9. Method according to claim 8, wherein:

the detecting means is located in the at least one extractible or removable drawer, and a branch duct of the water circulation system leads to the at least one extractable or removable drawer.

10. Method according to claim 1, wherein during the filtering process with the filtering means, the water is filtered with a decreasing aperture size of the filtering means over time.

11. Method according to claim 1, wherein a pre-filter is provided before the filtering means for the microfibers in the water circulation system.

12. Method according to claim 1, wherein the filtering means comprises a collecting chamber for the microfibers transported thereto from a filter surface, the collecting chamber being connected to a filter chamber.

13. Method according to claim 1, wherein an outlet of the washing machine is directed into the sewage of a house, wherein the microfibers collected in the filtering means have been treated to clot together to a bigger size with a diameter of more than 2 mm.

14. Method according to claim 1, wherein the filtering means has a filter chamber with two filter outlets out of the filter chamber, wherein before each filter outlet a filter membrane is provided and wherein a water inlet into the filter chamber is provided in order to filter water in the water circulation system from the sump back into the drum.

15. Method according to claim 1, wherein microfibers collected in the filtering means are treated for easier removing by a treating means, wherein the microfibers are treated to clot to a bigger size with a diameter of at least 2 mm.

16. Method according to claim 15, wherein the clotted microfibers are flushed out of the filtering means and transported back into the water circulation system after the washing drum and before the circulation pump.

17. Method according to claim 15, wherein the clotted microfibers are collected in a collecting chamber for later disposal by a user after accessing the collecting chamber or removing the collecting chamber from the washing machine.

18. Method according to claim 15, wherein the treatment of the collected microfibers comprises a step with a thermal treatment by at least one of the following means: introducing hot water into the filtering means, radiation heat onto the microfibers collected in the filtering means, microwaves, direct heating of the filtering means or a mesh thereof, respectively.

19. Method according to claim 15, wherein the treatment of the collected microfibers comprises a step with a chemical treatment by introducing chemical additives into the filtering means.

20. Method according to claim 15, wherein the treatment of the collected microfibers comprises a step with a bioremediation with an addition of enzymes from an enzyme supply or a bacteria supply.

21. Method according to claim 15, wherein the treatment of the collected microfibers comprises a step with a mechanical treatment.

22. Method according to claim 1, further comprising the step of:

detecting whether the presence of microfibers in the water circulation system exceeds a threshold for a percentage of microfibers in the water in the water circulation system, wherein, based upon the detecting that the presence of the microfibers in the water circulation system exceeds the threshold, the operation of the washing machine comprises at least one of the following steps:

adapting or lowering a rotational speed of the drum, adapting or lowering a temperature of the water in the water circulation system, introducing at least one specific additive into the water circulation system for changing a pH-value of the water in the water circulation system, introducing at least one additive into the water circulation system for enhanced decalcification, introducing a friction-reducing surfactant into the water circulation system, or changing a detergent added to the washing process from powder form to liquid form.

23. A washing machine comprising:

a drum for conducting a washing process therein, a sump located underneath the drum for collecting water exiting the drum, a water circulation system including at least one of an extractible or a removable drawer for introducing detergent or additives for the washing process, the water circulation system being in fluid connection to a detecting means for detecting microfibers in the water, a circulation pump for circulating water in the water circulation system; and a filtering means configured for filtering out microfibers in the water circulation system;

wherein:

the water circulation system is configured for branching off an amount of water circulating in the water circulation system and transporting it to the detecting means to be analyzed;

the detecting means is configured for analyzing the branched off amount of water; and depending on the result of this analysis, the detecting means causes activation of a filtering process whereby the filtering means filters out the microfibers from the water.

* * * * *